US011098499B2

(12) United States Patent
Shaw

(10) Patent No.: US 11,098,499 B2
(45) Date of Patent: Aug. 24, 2021

(54) PACKAGE SECURING SYSTEM

(71) Applicant: Brock A. Shaw, Olathe, KS (US)

(72) Inventor: Brock A. Shaw, Olathe, KS (US)

( * ) Notice: Subject to any disclaimer, the term of this patent is extended or adjusted under 35 U.S.C. 154(b) by 0 days.

(21) Appl. No.: 16/865,481

(22) Filed: May 4, 2020

(65) Prior Publication Data

US 2020/0347645 A1 Nov. 5, 2020

Related U.S. Application Data

(60) Provisional application No. 62/842,926, filed on May 3, 2019.

(51) Int. Cl.

| | |
|---|---|
| ***E05B 65/52*** | (2006.01) |
| ***E05B 73/00*** | (2006.01) |
| ***B65D 33/16*** | (2006.01) |

(52) U.S. Cl.

CPC ..... *E05B 65/52* (2013.01); *B65D 33/16* (2013.01); *E05B 73/00* (2013.01); *B65D 2211/00* (2013.01)

(58) Field of Classification Search

CPC ..... E05B 65/52; E05B 73/00; B65D 33/16; B65D 2211/00

USPC ..... 383/92

See application file for complete search history.

(56) References Cited

U.S. PATENT DOCUMENTS

| | | | | | |
|---|---|---|---|---|---|
| 471,167 | A * | 3/1892 | Beasley | B65D 33/165 | 383/71 |
| 1,683,294 | A * | 9/1928 | Low | A45C 13/10 | 70/64 |
| 1,982,813 | A * | 12/1934 | Jacobi | E05B 65/52 | 70/65 |
| 3,200,868 | A * | 8/1965 | Strayer | A45C 13/18 | 383/86 |
| 3,637,180 | A * | 1/1972 | Parry | A47B 81/005 | 248/553 |
| 4,420,857 | A * | 12/1983 | Clay | D06F 95/004 | 24/16 PB |
| 4,716,745 | A * | 1/1988 | Hehn | E05B 15/143 | 70/370 |
| 4,740,090 | A * | 4/1988 | McNamee | B65D 33/25 | 383/5 |

* cited by examiner

*Primary Examiner* — Jes F Pascua
(74) *Attorney, Agent, or Firm* — Steve O'Donnell

(57) ABSTRACT

A package securing system is disclosed suitable for large and small packages and envelopes. Said package securing system comprises a container into which a user would place items to be secured, and a peg or post onto which the user would place the container. Sliding the container past a flange on the peg causes the container to be locked onto the peg. A user may then operate an unlocking mechanism to remove the barrier to removal. The disclosed package securing system is easy to use prompting adoption by delivery persons.

3 Claims, 11 Drawing Sheets

PACKAGE SECURING SYSTEM

FIELD OF THE INVENTION

The subject matter of this application pertains to devices and methods to prevent package theft. More particularly, the subject matter of this application pertains to a device and method for preventing package theft which is easy for a delivery person or recipient to use, but difficult for a potential thief to defeat. Even more precisely, the subject matter of this application pertains to devices and methods for using a semi-rigid receptacle and securing means to secure delivered packages against casual thieves or "porch pirates."

BACKGROUND

Although details have been lost to time, one can assume the first case of mail theft wasn't very long after the first mail delivery. Home package delivery used to be somewhat uncommon, reaching a peak during the winter holiday gift-giving season, and so the usefulness of package securing systems was limited. More recently though, the ease of buying things online has caused package delivery to dramatically increase which has had the unwanted effect of increasing the instance of package theft.

Typically, a package carrier leaves packages on a stoop, doorway, porch, or other such areas outside of a residence. Sometimes there is a knock to facilitate handing over the package, but as increased deliveries mean decreased time allowed per delivery often a package is dropped in front of a door, and the delivery person dashes back to the truck. All a potential package thief needs to do is look for packages outside of a house and grab them.

Of course, unlike when one might presume a delivered package contained something special that could be easily resold, today's packages are much more common and are as likely to contain cleaning products or pet supplies as they are to contain electronics or gifts. Accordingly, today's thieves need to balance the risk of getting caught against the reward of a successful theft. Therefore, a package securing solution doesn't necessarily need to offer the security of a bank vault, but just enough to make a thief decide to move to the next door to grab an unsecured package.

Package securing devices and systems known in the art such as U.S. Pat. Nos. 10,143,320, 9,926,108, 1,500,251, 4,909,052, 4,998,424, and 5,624,071. Some of the known devices are perhaps too expensive for wide acceptance, but the largest problem with the known devices is that although their use may be quite simple, package delivery people simply aren't going to intuitively know how to use the device, and they may not be interested in learning if securing the package means they need to spend a minute at a door fiddling with a mechanism. Certainly, the package delivery companies are not going to want the drivers to spend time on such things when their responsibility for the package ends when it reaches the door, and taking the time to secure a package means a driver can deliver fewer packages per day or will require overtime to complete the route.

SUMMARY

The subject matter of this application is related to devices and methods that secure packages. More particularly, the subject matter of this application pertains to devices and methods that allow one to place a delivered package in a theft-resistant receptacle and easily and quickly secure such receptacle and which further allows a recipient to easily and quickly retrieve said package from the theft-resistant receptacle.

A package-securing system is comprised of a container such as a semi-rigid bag or basket in which a package may be placed before the container is reversibly secured to locking means attached to a surface such as a door, which prevents the bag or basket from being opened or removed from the locking means. The recipient may release the locking means to access the inside of the bag or basket. In a preferred embodiment, the delivery person need only place the bag or basket containing the package onto the locking means to secure it. This ease of securing the package encourages delivery person compliance.

DETAILED DESCRIPTION

The following description and drawings referenced therein illustrate embodiments of the application's subject matter. They are not intended to limit the scope. Those familiar with the relevant arts will recognize that other embodiments of the disclosed method are possible. All such alternative embodiments should be considered within the scope of the application's disclosure.

Each reference number consists of three digits. The first digit corresponds to the figure number in which that reference number is first shown. Reference numbers are not necessarily discussed in the order of their appearance in the figures. Drawings are not necessarily to scale. Certain features such as the flange have been exaggerated to aid the reader's understanding.

A package securing systems is comprised of a container (101) and a peg (201).

Figure 1:
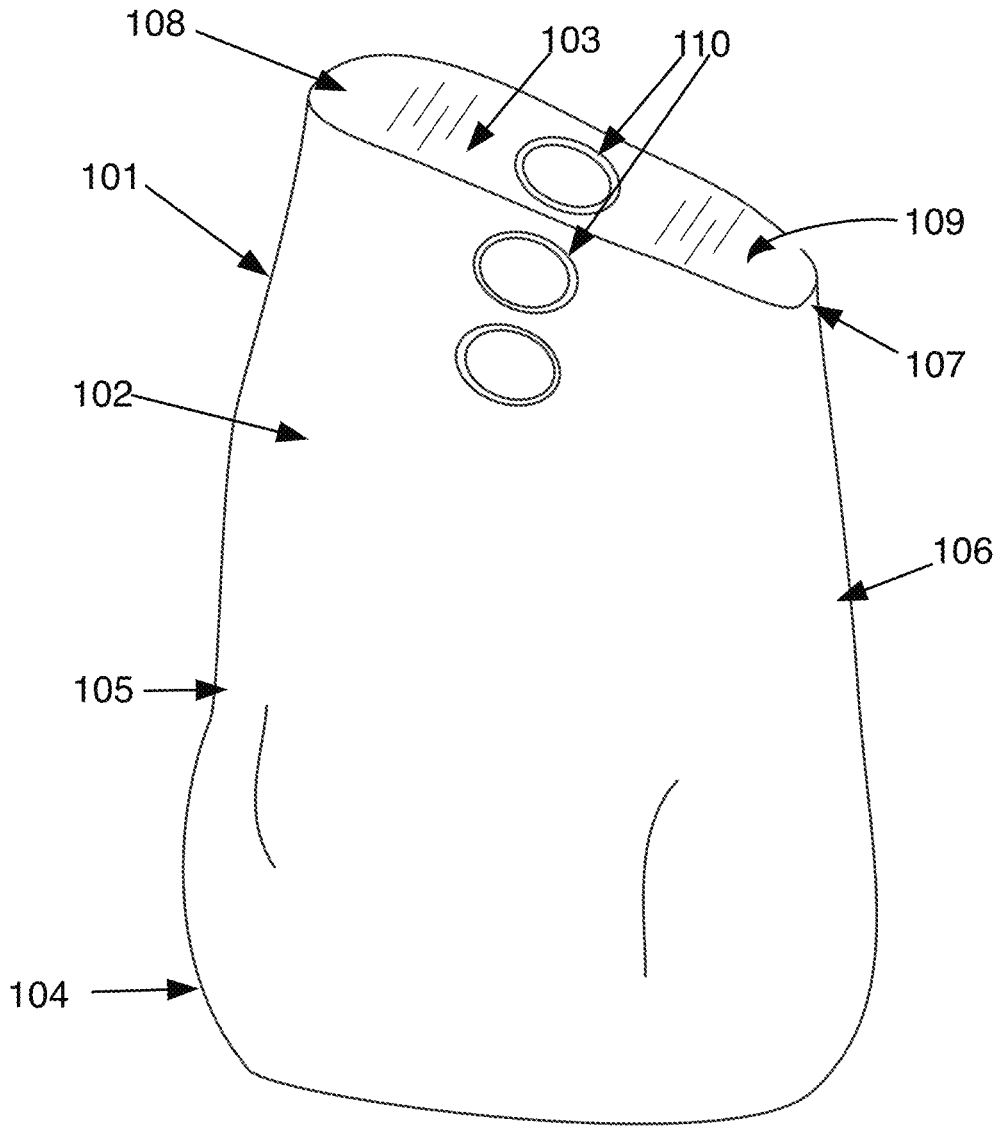
FIG. 1 is an illustration of an opened and empty container.
Figure 2:
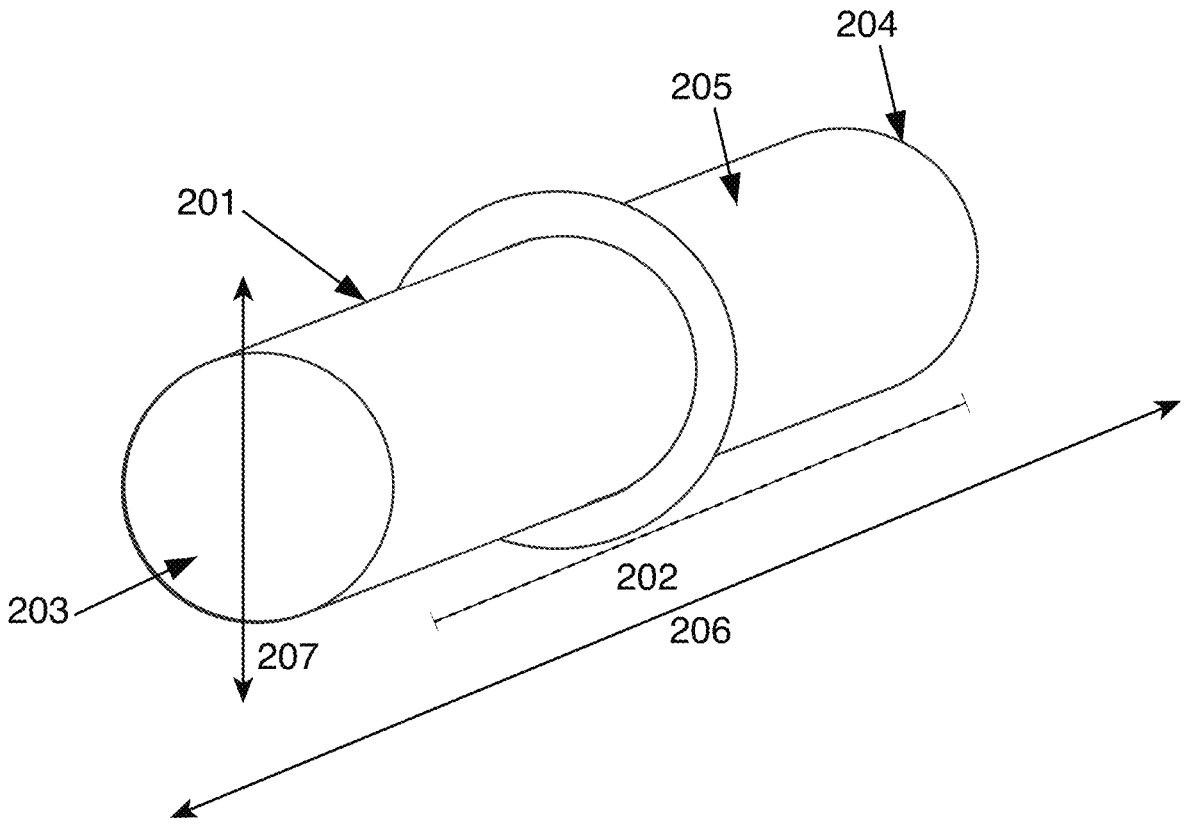
FIG. 2 is an illustration of the peg with a retracted flange.
Figure 3:
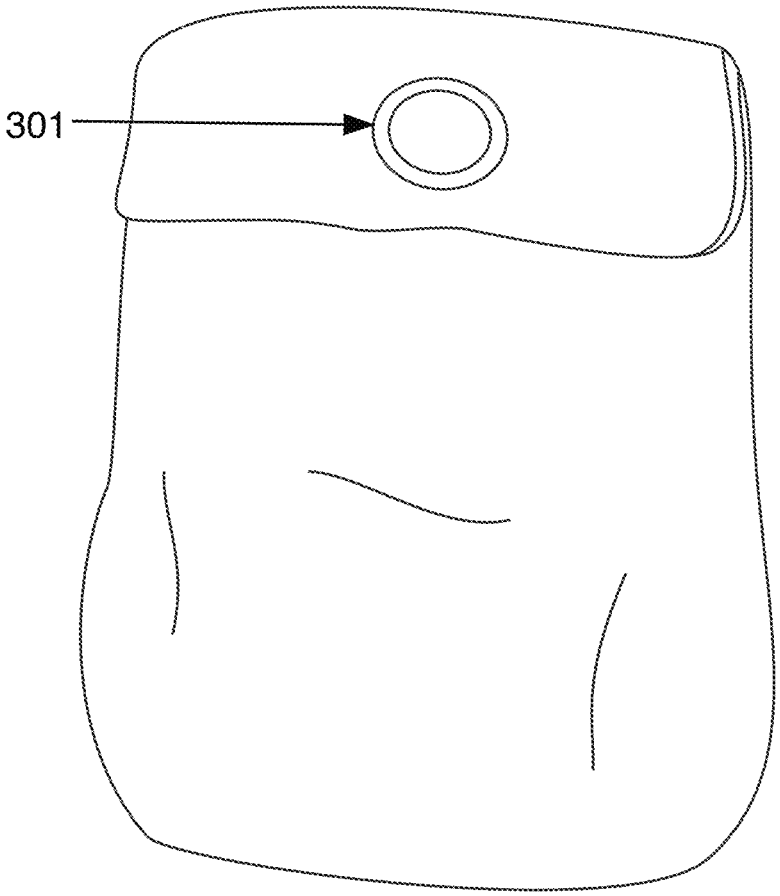
FIG. 3 is an illustration of the closed container.
Figure 4:
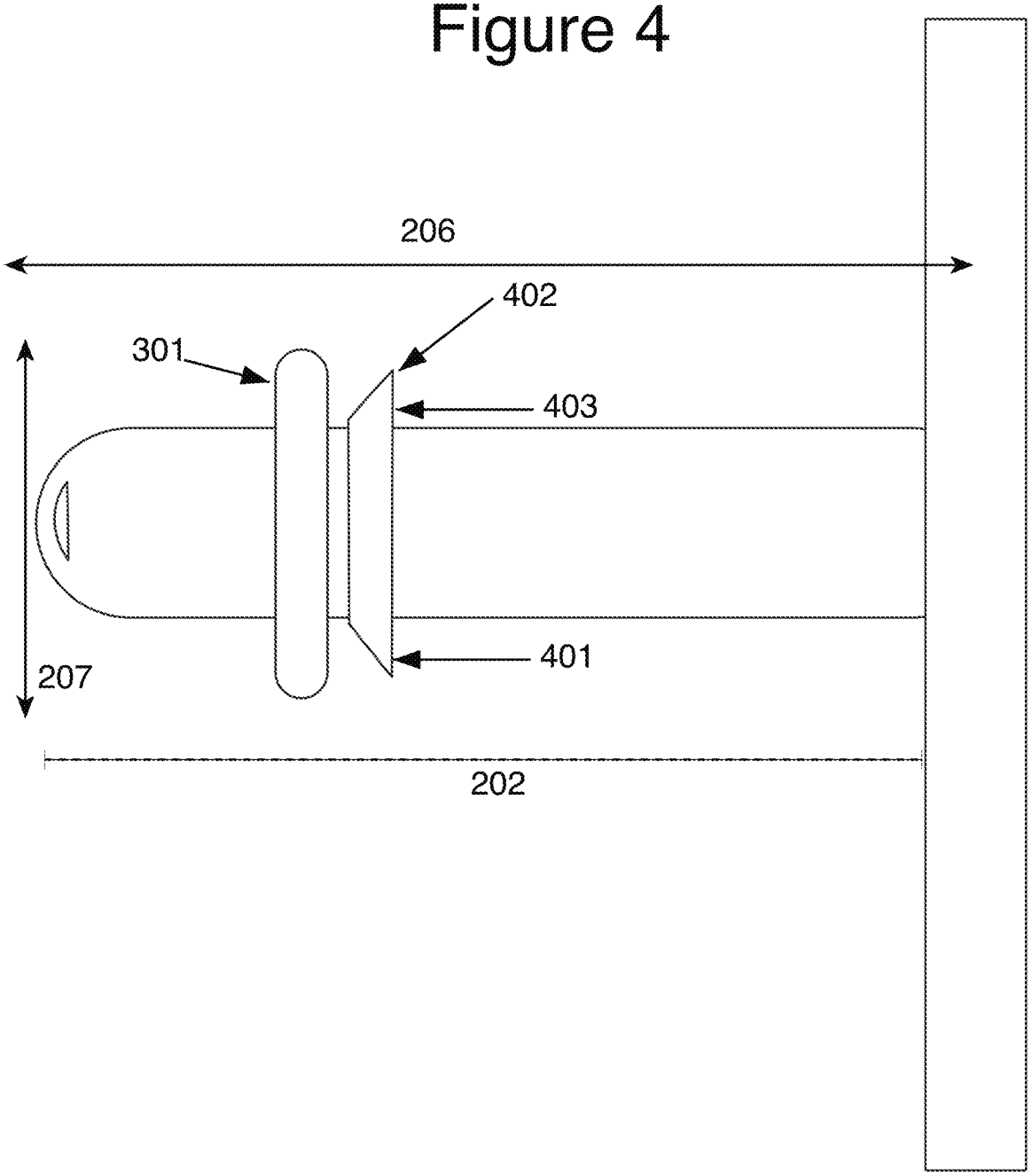
FIG. 4 is an illustration of the border support of a container placed on the peg. The rest of the container is omitted for clarity.

Said container comprises an outside surface (102), an inside surface (103), a bottom (104), a first side (105), a second side (106), and a top (107) comprising an opening (108). Said inside surface defines an inner compartment (109). The container is further comprised of at least two conformations. In the first said conformation, the inner compartment of the container is open and items may be placed inside (FIG. 1). In the second said conformation the inner compartment of the container is closed (FIG. 3). In certain preferred embodiments, the container is a hard side case. In certain other preferred embodiments, the container is a soft-sided bag or similar structure made of a durable and water-resistant material such as ballistic nylon. In the interest of brevity and clarity, a soft-sided bag embodiment is further described and shown in the drawings. Said container further comprises the first member of a two-member attachment system. In a most preferred embodiment, said first member is comprised of a channel. In most preferred embodiments, said channel is comprised of a first hole (110) passing through the container. Said first hole is bordered by a border support (301). Said border support is preferably constructed of a material such as a firm plastic or metal. Said border support and hole having a shape. In most preferred embodiments, said border support and hole are annular or circular. In preferred embodiments, said hole and border support are located near the top of the container. In a most preferred embodiment, said container further comprises a second hole and border support located under the first hole and border support such that the top of the container may be folded between the first and second holes such that the two holes align forming a channel. Said hole or holes and the corresponding border supports may be any appropriate shape although in most preferred embodiments the most appropriate shape is circular or annular.

Figure 5:
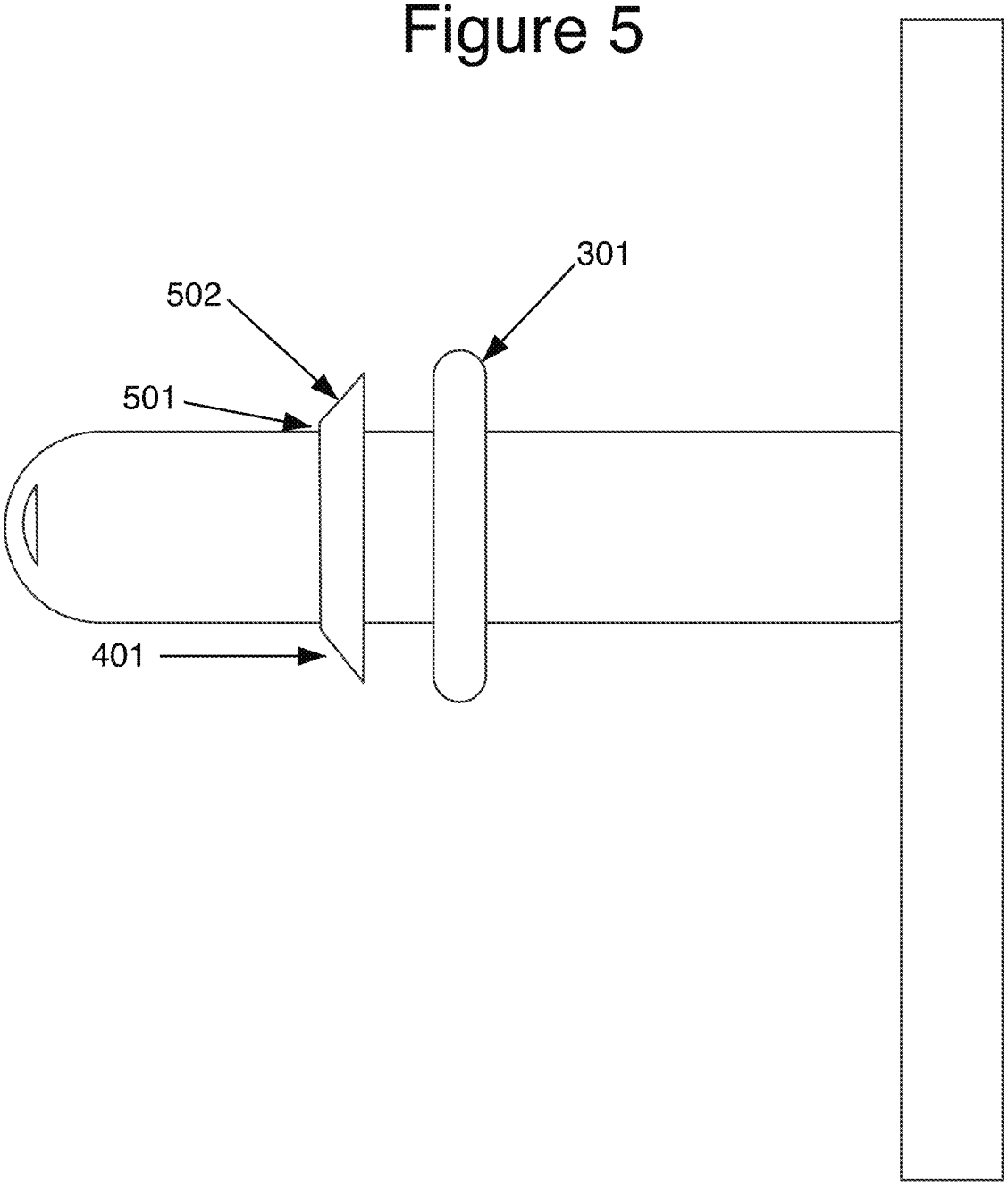
FIG. 5 is an illustration of the border support of the container past the flange of the peg.
Figure 6:
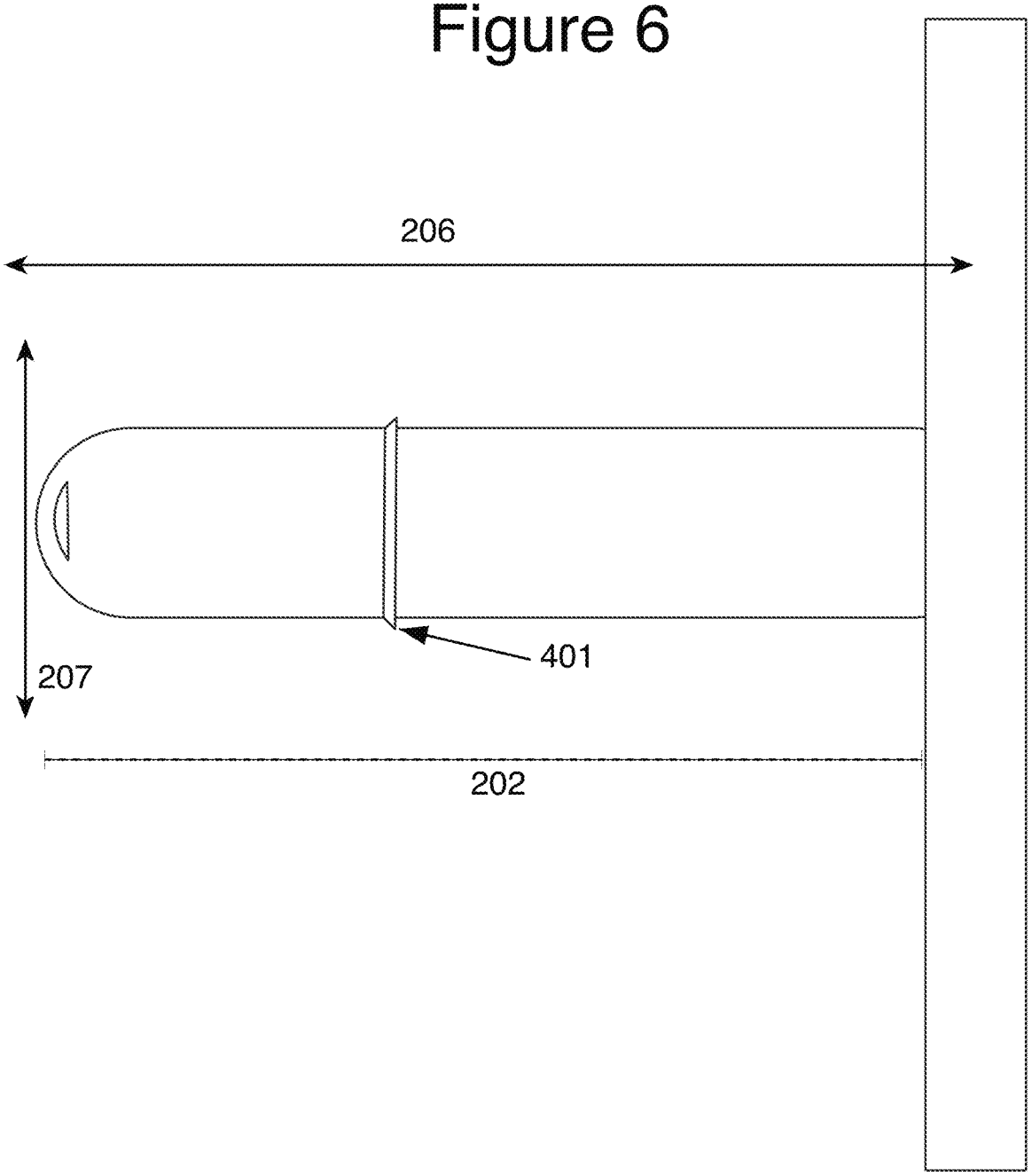
FIG. 6 is an illustration of the flange of the peg in the retracted position.
Figure 9:
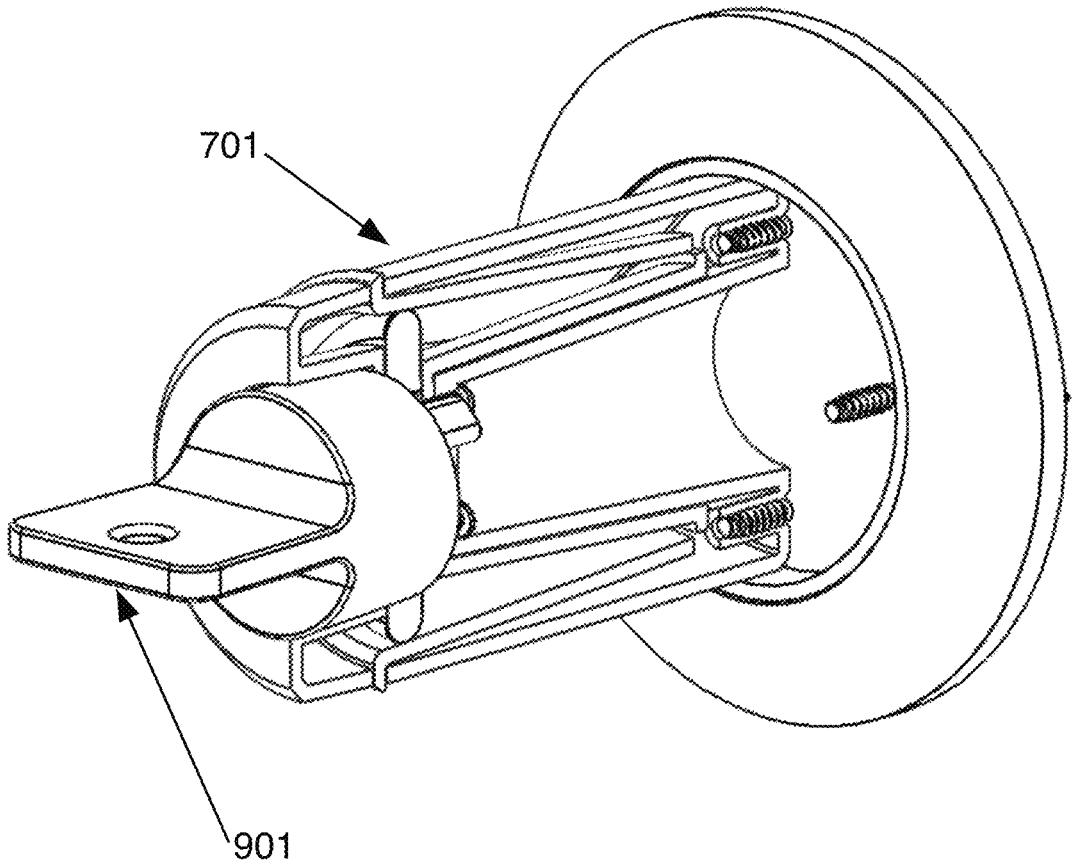
FIG. 9 is a cutaway illustration of one type of cam lock suitable for use with the invention.
Figure 10:
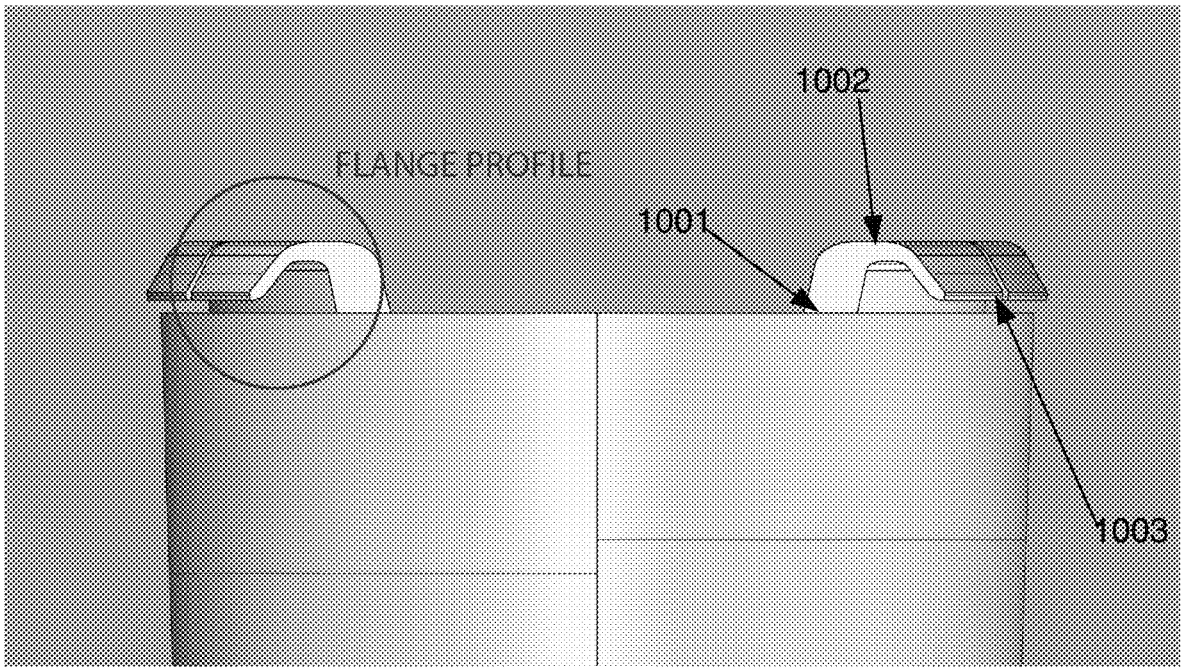
FIG. 10 is a view of a bending-flange embodiment showing greater detail of the flange(s).
Figure 11:
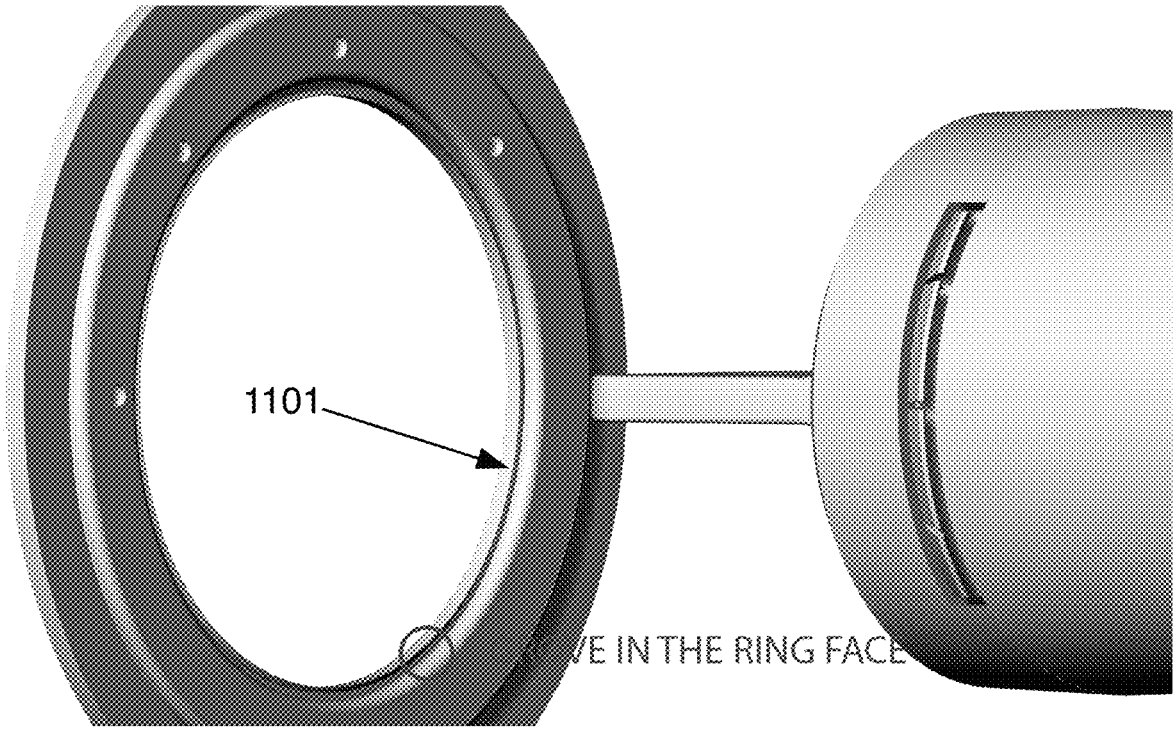
FIG. 11 is a view of the border support showing the groove described for a bending-flange embodiment.

Said peg comprises a length (202), a first end (203), a second end (204), an outer surface (205), a longitudinal axis (206), and a transverse axis (207). The structure of the peg is such that the hole or holes of the container can slide across the longitudinal axis of the peg. The peg further comprises a locking mechanism (701) such as a cam lock (FIG. 9) and a retractable flange (401). Said flange is coupled to the locking mechanism such that operation of the locking mechanism causes the flange to extend (FIG. 5) or retract (FIG. 6) into the peg by moving parallel to the transverse axis of the peg. In most preferred embodiments this locking mechanism (701) is operable from the first end of the peg. The flange comprises an apex (402), a first face (501) and a second face (403). Said first face of the flange is proximal to the first end of the peg and said second face of the flange is proximal to the second end of the peg. The first face of the flange comprises a slanted portion (502). Said slanted portion has a positive slope extending from a low point proximal to the first end of the peg to the apex of the flange. In most preferred embodiments the peg is secured to a structure such as a door or a wall, where the longitudinal axis of the peg may be largely transverse to the axis of gravity, while in other embodiments the peg may be secured to a surface such that the longitudinal axis of the peg is largely parallel to the axis of gravity. Said peg may also be secured at an angle from the axis of gravity as the user may prefer.

Most preferred embodiments of the package securing system further comprise a tool such as a key (901) that operates the locking mechanism of the peg.

Figure 7:
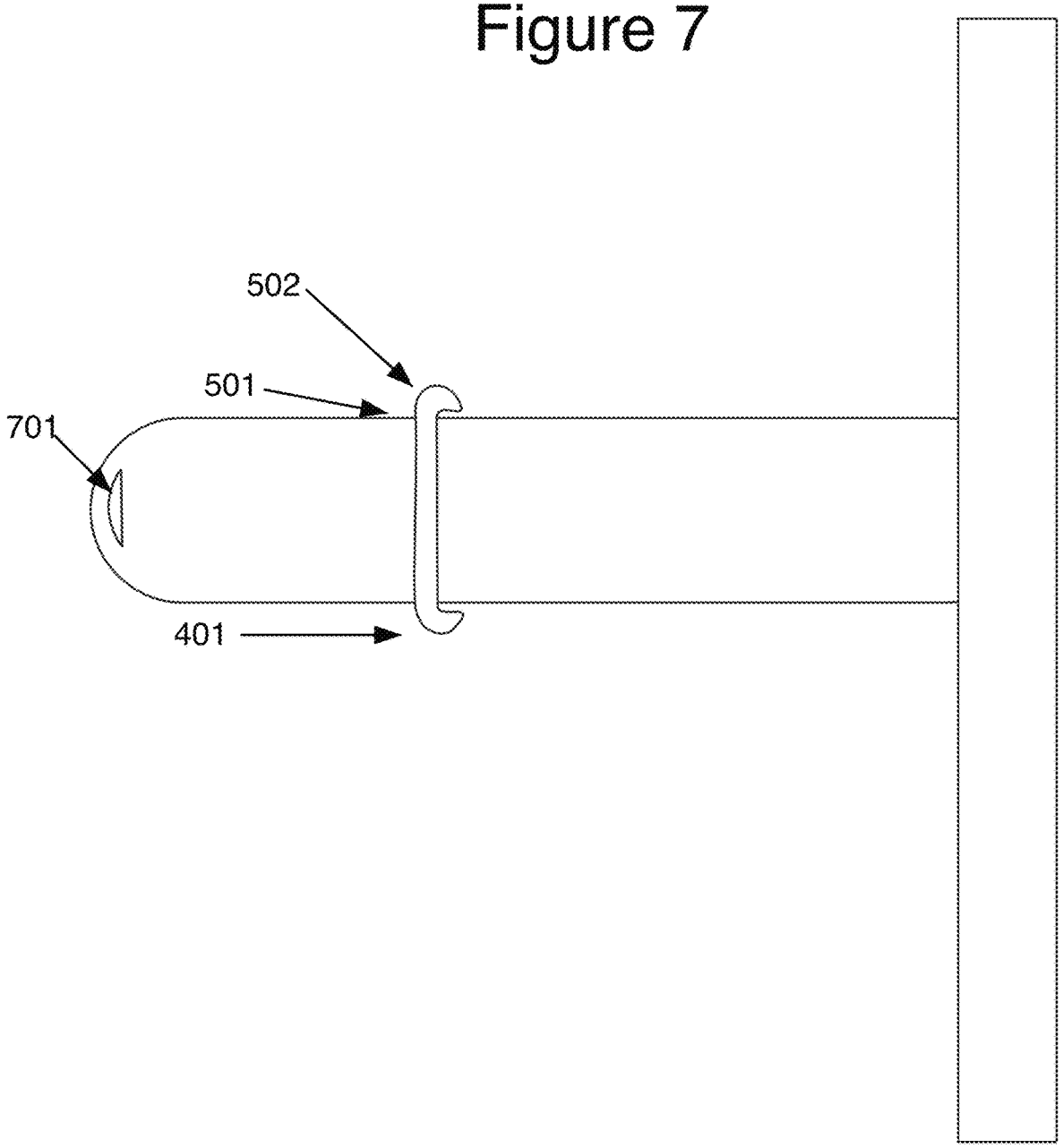
FIG. 7 is an illustration of the flange of the peg bent toward the second end of the peg as a border support (not illustrated) is moved over the flange.
Figure 8:
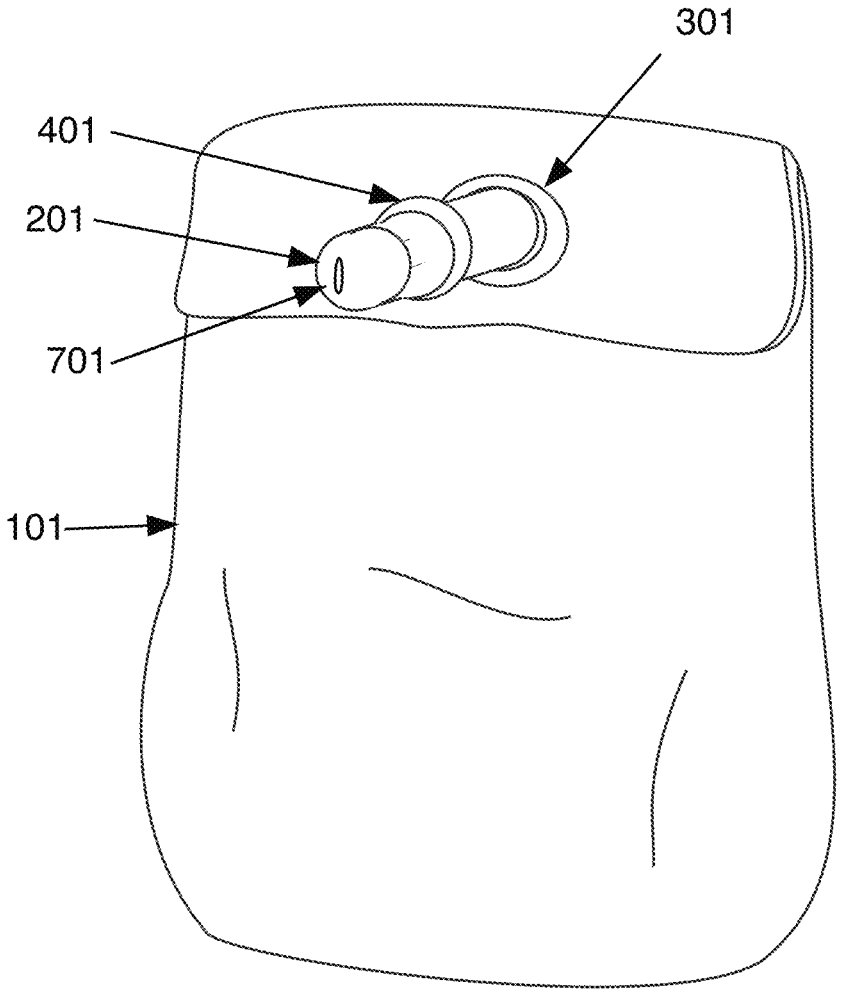
FIG. 8 is an illustration of the container secured to the peg.

As the package securing system may be commonly used, a user places one or more packages into the inner compartment of the container and folds the top portion of the container so that the holes align. Folding the top in this way helps prevent water damage to the packages if it is raining, and further prevents a prospective thief from seeing the contents of the container. The holes and the associated border supports are then slid past the first end of the peg and toward the second end of the peg and pressed against the slanted portion of the first face of the extended flange of the peg. In a most highly preferred embodiment, the flange comprises a semi-circle having a stable end (1001) a terminus (1002) and a body (1003). Said body of the flange can bend or pivot causing the terminus to move toward the second end of peg in response to a force applied parallel to the longitudinal axis of the peg. This movement (FIG. 7), allows the border support to pass over the flange. The flange would then return to the previous conformation and prevent the border support from being moved past the flange in the direction of the first end of the peg. In certain variations of this embodiment, the border support of the container further comprises a groove (1101) within the channel that catches the terminus of the flange when the container is moved from near the second end of the peg toward the first end of the peg, preventing the container from moving past the flange and off the peg. within. In another preferred embodiment, pressure on the flange as the border support is pressed against the flange and toward the second end of the peg cause the flange to retract into the peg, so the holes and associated border supports can move past the retracted flange. After clearing the retracted flange, the flange returns to the extended position, thereby preventing the container from moving in the opposite direction toward the first end of the peg.

A user may cause the flange to retract into the peg by using a tool such as a key. Once the flange is retracted, the container may be removed from the peg.

The invention claimed is:

1. A package securing system comprising a container and a peg, a. said container comprising an inner compartment and a first member of a two-member attachment system,
  i. said inner compartment being capable or containing one or more items placed inside, b. said peg comprising a surface, a first end, a second end, and a second member of said two-member attachment system,
  i. the second member of said two-member attachment system of the peg comprises a locking mechanism and a retractable flange,
    a) said retractable flange comprises an apex, a first face and a second face,
      i) said first face of the retractable flange being proximal to the first end of the peg and comprising a slant rising from approximately the surface of the peg to the apex of the flange,
      ii) said retractable flange capable of bending toward the second end of the peg,
    b) said locking mechanism comprising a cam lock which operates to extend or retract the flange from the peg.

2. A package securing system comprising a container and a peg, a. said container comprising an inner compartment and a first member of a two-member attachment system,
  i. said inner compartment being capable or containing one or more items placed inside, b. said peg comprising a surface, a first end, a second end, and a second member of said two-member attachment system,
  i. the second member of said two-member attachment system of the peg comprises a locking mechanism and a retractable flange,
    a) said retractable flange comprises an apex, a first face and a second face,
      i) said first face of the retractable flange being proximal to the first end of the peg and comprising a slant rising from approximately the surface of the peg to the apex of the flange,
      ii) Said flange retracting into the flange when pressure parallel to the longitudinal axis of the peg is exerted against the slant of the first face of the flange toward the second end of the peg, b) said locking mechanism comprising a cam lock which operates to extend or retract the flange from the peg.

3. A package securing system comprising a container and a peg, a. said container comprising an inner compartment and a first member of a two-member attachment system, i. said inner compartment being capable or containing one or more items placed inside, b. said peg comprising a surface, a first end, a second end, and a second member of said two-member attachment system, i. the second member of said two-member attachment system of the peg comprises a locking mechanism and a retractable flange, a) said retractable flange comprises an apex, a terminus, a first face and a second face, i) said first face of the flange being proximal to the first end of the peg, ii) said terminus of the flange moving toward the second end of the peg and toward the surface of the peg when pressure parallel to the longitudinal axis of the peg is exerted against the first face of the flange toward the second end of the peg, b) said locking mechanism comprising a cam lock which operates to extend or retract the flange from the peg.

* * * * *